US005808399A

United States Patent [19]

Yoneyama

[11] Patent Number: 5,808,399

[45] Date of Patent: Sep. 15, 1998

[54] FILAMENT SUPPORTING STRUCTURES IN INCANDESCENT LAMPS AND PROCESS FOR FIXING FILAMENTS ONTO SUPPORTS

[75] Inventor: Masatoshi Yoneyama, Shimizu, Japan

[73] Assignee: Koito Manufacturing Co., Ltd., Tokyo, Japan

[21] Appl. No.: 613,780

[22] Filed: Feb. 28, 1996

[30] Foreign Application Priority Data

Mar. 16, 1995 [JP] Japan ..... 7-084897

[51] Int. Cl.[6] ..... H01J 1/88; H01J 19/42; H01J 1/94; H01J 19/48

[52] U.S. Cl. ..... 313/271; 313/279; 313/272

[58] Field of Search ..... 313/271, 272–79, 313/569, 573–74, 578–79, 315, 635

[56] References Cited

U.S. PATENT DOCUMENTS

| | | | |
|---|---|---|---|
| 3,524,693 | 8/1970 | Kubo et al. | 313/271 |
| 3,612,940 | 10/1971 | Sims | 313/271 |
| 4,801,845 | 1/1989 | Kiesel | 313/879 |
| 4,896,074 | 1/1990 | Williams et al. | 313/635 |
| 5,043,624 | 8/1991 | Hirozumi et al. | 313/318 |

*Primary Examiner*—Sandra L. O'Shea
*Assistant Examiner*—Mack Haynes
*Attorney, Agent, or Firm*—Sughrue, Mion, Zinn, Macpeak & Seas, PLLC

[57] ABSTRACT

Disclosed are a process for fixing a filament onto a support in an incandescent lamp in which the filament is prevented from being deformed when it is welded onto a support and also a filament supporting structure to be established by the process. The filament fixing process comprises wrapping a foil body around each supporting end portion of a filament; squeezing the wrapped foil body together at positions close to each end thereof to form a cylindrical portion and a fin-like portion protruding from the cylindrical portion; and welding the cylindrical portion onto a support (e.g. a support wire or a supporting piece of a shade) for the filament such that the fin-like portion of the foil body may be situated within the distance or range corresponding to the diameter of the cylindrical portion as measured from the surface of the support.

6 Claims, 7 Drawing Sheets

FILAMENT SUPPORTING STRUCTURES IN INCANDESCENT LAMPS AND PROCESS FOR FIXING FILAMENTS ONTO SUPPORTS

BACKGROUND OF THE INVENTION

1. Field of the Invention

The present invention relates to a novel filament supporting structure in an incandescent lamp in which filaments are designed to be welded at the end portions through foil bodies to supports respectively and a process for fixing the filaments onto the supports. More particularly, the present invention is to provide a novel filament supporting structure and a process for fixing filaments onto supports in which contrivance is made on the state of fitting the foil bodies to the supports so as to prevent the filaments from being deformed when the filaments are welded to the supports.

2. Description of the Related Art

A filament in an incandescent lamp is designed to be fixed onto supports such as support wires, and it is practiced to attach molybdenum foil to each supporting end portion of the filament, at which the filament is supported on the support, and to weld the molybdenum foil to the support. Such technique is described, for example, in Japanese Patent Publication No. Sho 51-14835.

FIGS. 6 to 8 show one embodiment of prior art filament supporting structure in an incandescent lamp, in which a filament a consists of a coiled portion b and linear supporting end portions c,c' protruding from each tail end of the coiled portion b.

Pieces of molybdenum foil d,d' are wrapped around the supporting end portions c,c' of the filament a, and the wrapped foil d,d' is squeezed together at the positions close to each end thereof to be secured to the supporting end portions c,c', respectively.

The portions of the molybdenum foil d,d' wrapped around the supporting end portions c,c' are welded to support wires e,e' by means of spot welding to fix the filament a thereto (see FIGS. 8A and 8B).

However, the aforementioned filament supporting structure in an incandescent lamp involves a problem that the filament a is liable to be deformed after welding.

The molybdenum foil d is wrapped around the supporting end portion c of the filament a, and the wrapped foil is squeezed together at positions close to each end thereof. Thus, a cylindrical portion f having a cylindrical profile along the circumference of the supporting end portion c and a fin-like portion q extended from the cylindrical portion f are formed, so that the molybdenum foil d has a substantially P-shaped cross section when the foil d is cut along a plane orthogonal to the axis of the supporting end portion c, as shown in FIG. 7.

When the molybdenum foil d is welded with pressure to the support wire e between a pair of spot electrodes h,h', if the fin-like portion q is tilted with respect to the axial direction of the support wire e such that the fin-like portion q is spaced from the support wire e, the molybdenum foil d may be turned in the direction of the arrow R when one spot electrode h touches the fin-like portion g. Since the molybdenum foil d is secured to the supporting end portion c of the filament a, such turning of the molybdenum foil d acts to twist the entire filament a to deform it, for example, as shown in FIGS. 8A and 8B. Such inconvenience is also true with the molybdenum foil d' and the support wire e'.

The deformation of the filament a can be causative of various problems such as inhibition of desired light distribution.

SUMMARY OF THE INVENTION

In order to overcome the aforementioned problems, it is an objective of the present invention to provide a structure of supporting a filament in an incandescent lamp, comprising a filament having a coiled portion and supporting end portions extended from each tail end of the coiled portion; a foil body wrapped around each supporting end portion of the filament and squeezed together at positions close to each end thereof to form a cylindrical portion and the other portion; and a support on which the filament is welded such that the other portion of the foil body excluding the cylindrical portion may be situated within the distance or range corresponding to the diameter of the cylindrical portion as measured from the surface of the support. It is another objective of the present invention to provide a process for fixing a filament onto a support, which comprises wrapping a foil body around each supporting end portion of a filament; squeezing the wrapped foil body together at positions close to each end thereof to form a cylindrical portion and the other portion; and welding the cylindrical portion onto a support for the filament such that the other portion of the foil excluding the cylindrical portion may be situated within the distance or range corresponding to the diameter of the cylindrical portion as measured from the surface of the support. In the novel filament supporting structure in an incandescent lamps according to the present invention, the portion of the foil body excluding the cylindrical portion is designed to locate within the range corresponding to the diameter of the cylindrical portion as measured from the surface of the support before the foil body is welded onto the support.

According to the present invention, since the portion of the foil body excluding the cylindrical portion is located within the range corresponding to the diameter of the cylindrical portion as measured from the surface of the support, the end face of the welding machine only contacts the cylindrical portion of the foil body when the filament is to be welded to the support.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

FIGS. 1 to 5 show one embodiment of the present invention; in which:

FIG. 1 is an enlarged cross-sectional view of the major section of the filament supporting structure according to the present invention;

FIG. 2 is also an enlarged cross-sectional view of the major portion, in which a foil body is fixed to a support wire;

FIG. 3 is a partially cut-away side view of an incandescent lamp;

FIG. 5 shows in enlarged cross-sectional view of the major portion as a variation of FIG. 1.

FIGS. 6 to 8B show an example of prior art filament supporting structure; in which:

FIG. 6 is an enlarged side view of a filament;

FIG. 7 is an enlarged cross-sectional view of a major portion illustrating a probable problem; and FIGS. 8A and 8B show a variation of the filament in enlarged plan view and in enlarged side view respectively.

DETAILED DESCRIPTION OF THE PREFERRED EMBODIMENTS

The filament supporting structure in an incandescent lamp and process for fixing filaments to supports according to the present invention will be described in detail by way of illustrated embodiments.

Figure 3:
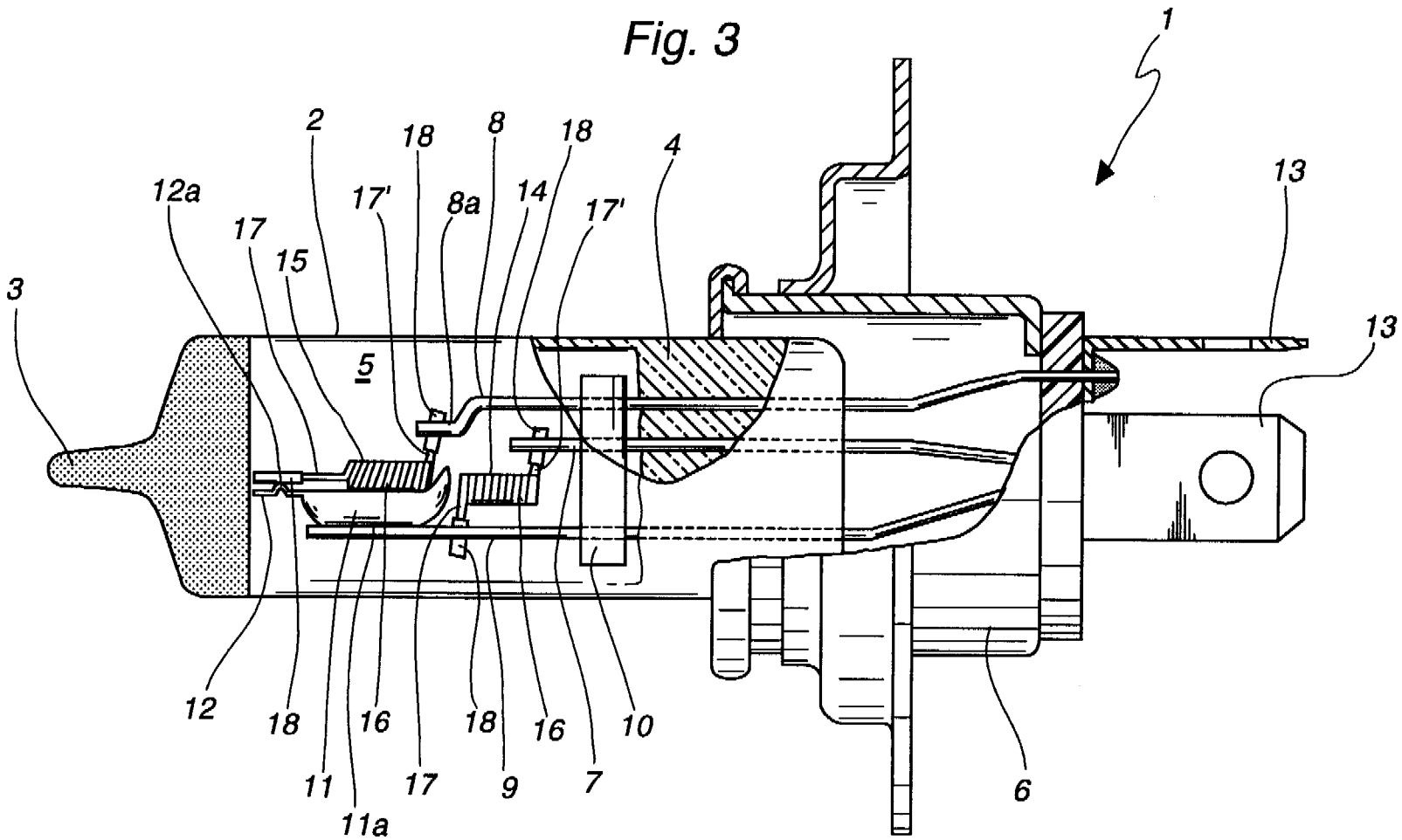

In FIG. 3, the reference number 1 denotes an incandescent lamp, that is a tungsten halogen lamp with a base, to which the present invention is applied.

A glass bulb 2 is closed at the front end by a tip-off portion 3 and at the rear end by a pinch-sealed portion 4 to define a closed space 5. A metal base 6 is fitted to the rear end portion of the glass bulb 2.

In this embodiment, filament supports are support wires 7,8,9 extended substantially in the horizontal direction and a supporting piece of a shade (to be described later). The support wires 7,8,9 are of tungsten wire material, and a portion of these wires 7,8,9 penetrate the pinch-sealed portion 4 of the glass bulb 2 to be sealed in and supported by that portion 4.

The reference number 10 denotes a glass bridge, which is fused to seal therein the support wires 7,8,9 at the portions within the closed space 5 of the glass bulb 2, and thus the support wires 7,8,9 are bound together.

Of the support wires 7,8,9, the wire 7 is a feed line for a main filament; the wire 8 is a feed line for a sub-filament; while the wire 9 is a common line. The common support wire 9 is located at a lowermost position, and the distal end of the support wire 9 is located at the foremost position, whereas the support wire 7 as the feed line for the main filament is located at an intermediate position. Meanwhile, the support wire 8 as the feed line for the sub-filament is located at an uppermost position, and the distal end of the support wire 8 is situated almost at the middle between the distal end of the support wire 7 and that of the support wire 9 with respect to the longitudinal direction, with the distal end 8*a* of the support wire 8 being cranked downward.

Figure 4A:
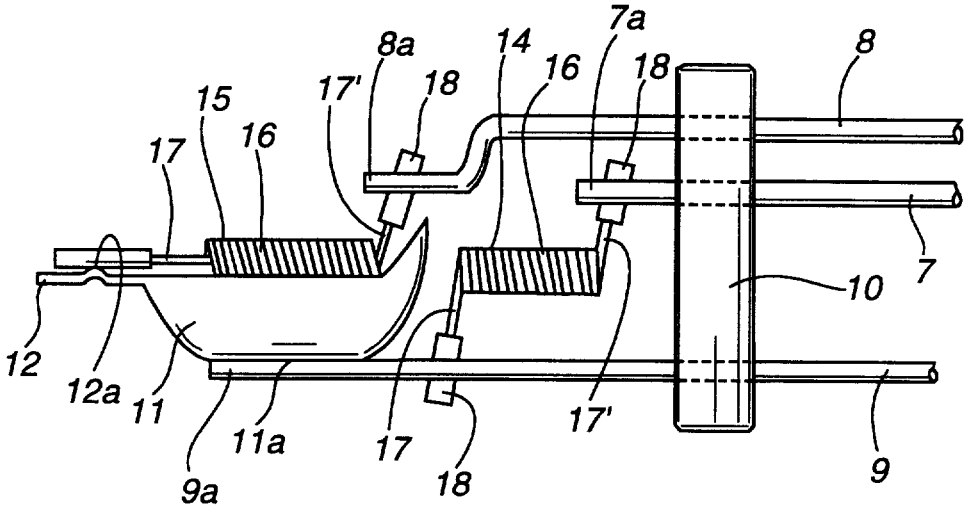
FIGS. 4A and 4B show a major portion where filaments are fixed to support wires or to a supporting piece of a shade in enlarged side view and in enlarged plan view respectively.
Figure 4B:
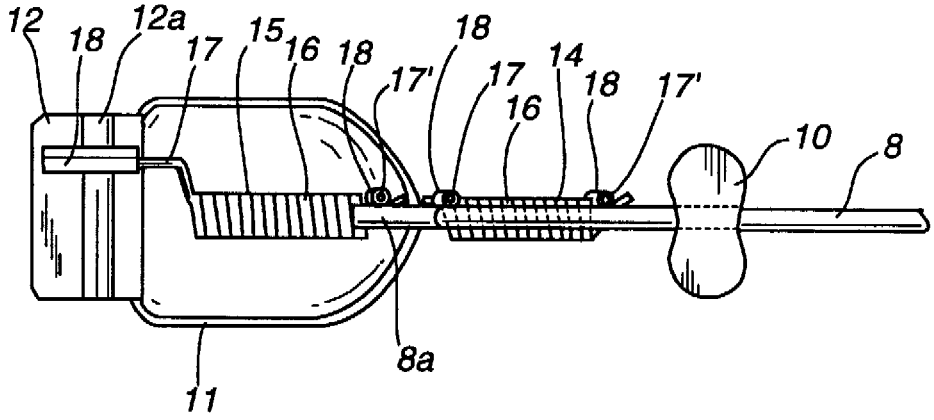

The reference number 11 denotes a metal shade having a boat-like shape, and a plate-like supporting piece 12 is formed integrally with the shade 11 to protrude from the front upper edge thereof (see FIGS. 4A and 4B), with a rib 12*a* being embossed on the upper surface of the supporting piece 12 to extend depthwise substantially at the middle with respect to the longitudinal direction. The bottom 11*a* of the shade 11 is welded to the distal end portion 9*a* of the common support wire 9.

Three terminal strips 13 protrude from the rears end of the base 6 and are connected to the proximal end portions of the support wires 7,8,9 respectively.

The reference number 14 denotes a main filament, and its front supporting end portion 17 is spot-welded via a foil body (to be described later) to the common support wire 9 immediately behind the position where the shade 11 is welded. Meanwhile, the rear supporting end portion 17' is spot-welded via a foil body (to be described later) to the distal end portion 7*a* of the support wire 7 as the feeder line for the main filament.

The reference number 15 denotes a sub-filament, and the front supporting end portion 17 is spot-welded via a foil body (to be described later) to the upper surface of the supporting piece 12 of the shade 11. Meanwhile, the rear supporting end portion 17' is spot-welded via a foil body 18 (to be described later) to the distal end portion 8*a* of the support wire 8 as the feeder line for the sub-filament.

These filaments 14,15 are made of tungsten and each are composed of a coiled portion 16 and a pair of supporting end portions 17,17*a* protruding from each tail end of the coiled portion 16. A pair of foil bodies 18 made of molybdenum and the like are secured to the supporting end portions 17,17' at the positions closer to each end thereof, respectively.

Figure 1:
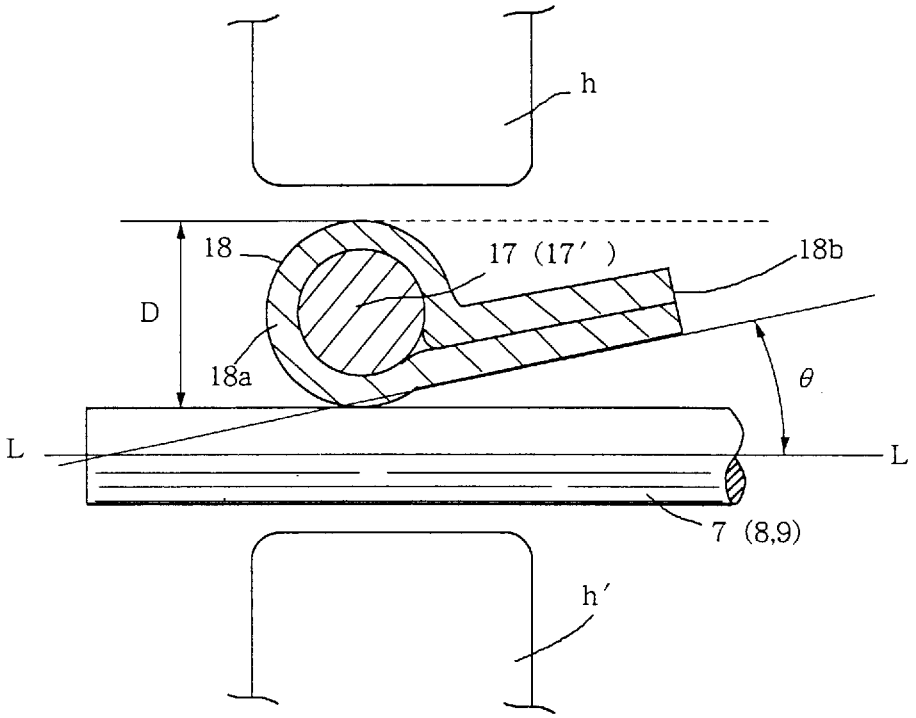

Specifically, the foil body 18 is wrapped around the supporting end portion 17 or 17', and the wrapped foil body is squeezed together at positions close to each end thereof to form a cylindrical portion 18*a* having a cylindrical form along the circumference of the supporting end portion 17 or 17' and a fin-like portion 18*b* protruding from the cylindrical portion 18*a,* as shown in FIG. 1. Thus, the foil body 18 is designed to have a substantially P-shaped cross section when the foil 18 is cut along a plane orthogonal to the axis of the supporting end portion 17 or 17'.

In FIG. 1, D is an outer diameter of the cylindrical portion 18*a,* and θ is an angle formed between the direction that the fin-like portion 18*b* protrudes and the axis L of the support wire 7(8,9).

When a filament is to be welded to a support wire, the fin-like portion 18*b* is allowed to situate within the range or distance D as measured from the surface of the support wire so that the distal end of the fin-like portion 18*b* may not protrude beyond this range.

Figure 2:
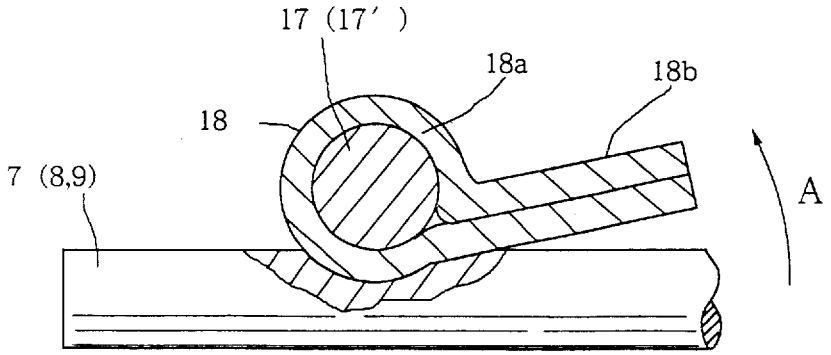
Figure 7:
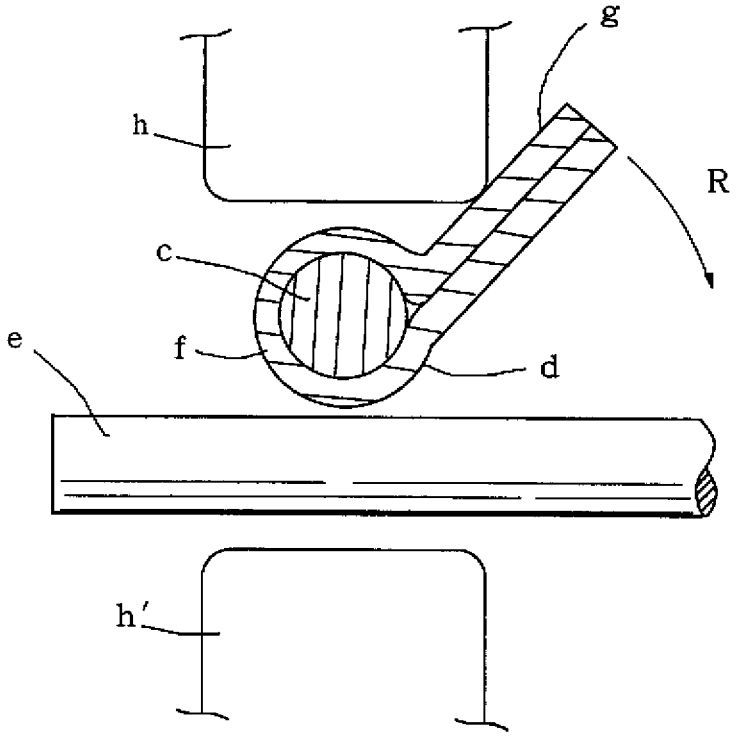
Fig. 7 PRIOR ART
Figure 8A:
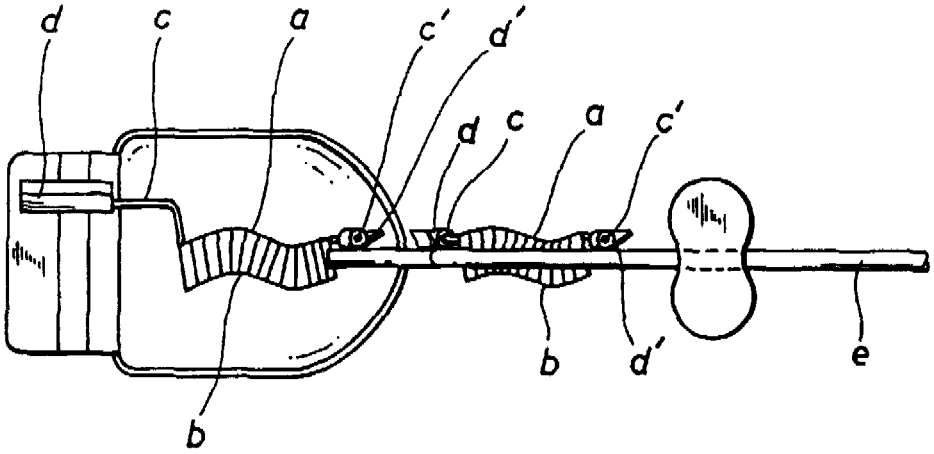
Fig. 8A PRIOR ART
Figure 8B:
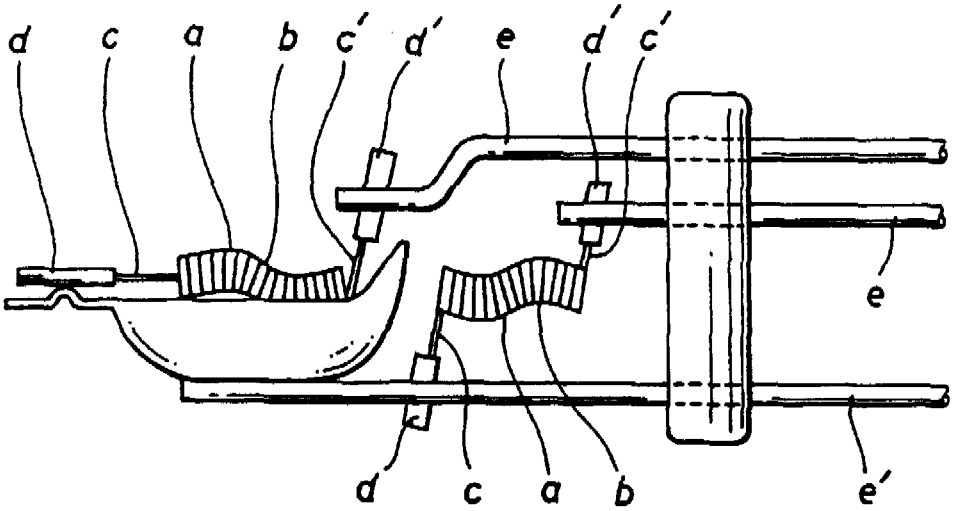
Fig. 8B PRIOR ART

More specifically, when the foil body 18 is welded with pressure to the support wire between a pair of spot electrodes h,h', the end face of one spot electrode h is prevented from being brought into contact with the fin-like portion 18*b,* even if the direction that the fin-like portion 18*b* protrudes is slanted by the angle θ with respect to the axis (L—L) of the support wire as shown in FIG. 1, so long as the fin-like portion 18*b* is slanted at an angle included within the range D. Accordingly, since the foil body 18 is prevented from being turned by the spot electrode h, there occurs no inconvenience that the filament is twisted by the turning of the foil 18. As the angle θ formed between the fin-like portion 18*b* and the support wire is preferably, for example, in the range of 9° to 14.5° when D=0.3 mm and the length of fin-like portion=1.2 mm, particularly preferably around 12°. That is, if θ>14.5°, the end of the fin-like portion 18*b* is likely to be abutted against the end face of the spot electrode h; whereas if θ<9°, the fin-like portion 18*b* is turned in the direction of the arrow A when the cylindrical portion 18*a* is partly embedded in the support wire by the welding, as shown in FIG. 2, to apply a force to the fin-like portion 18*b* in the opposite direction as compared with the case shown in FIG. 7, so that the filament is occasionally twisted.

Incidentally, the relationship between the foil body 18 and the support wires 7 to 9 shall apply to the relationship between the foil body 18 and the supporting piece 12 of the shade 11 (which is not illustrated).

Figure 5:
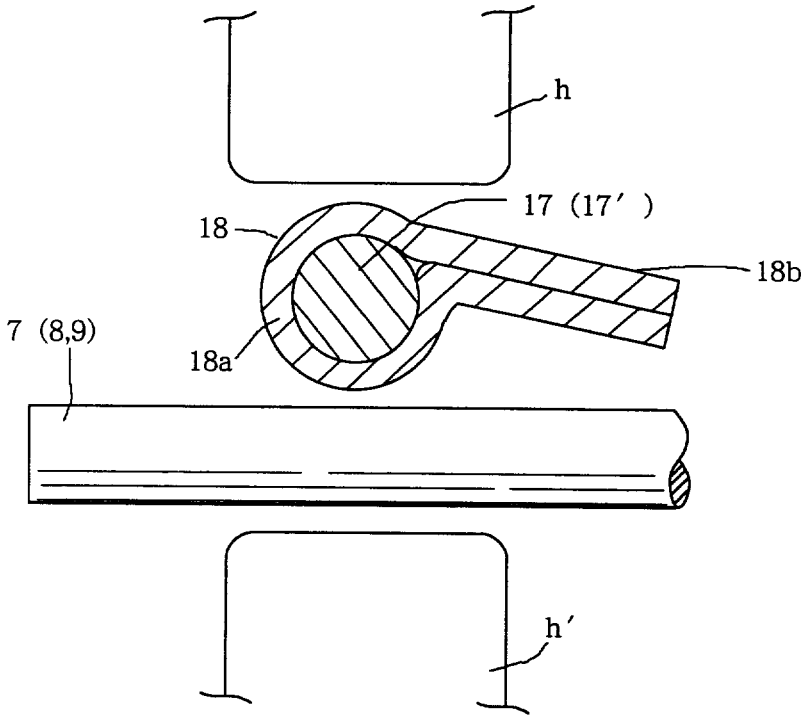
Figure 6:
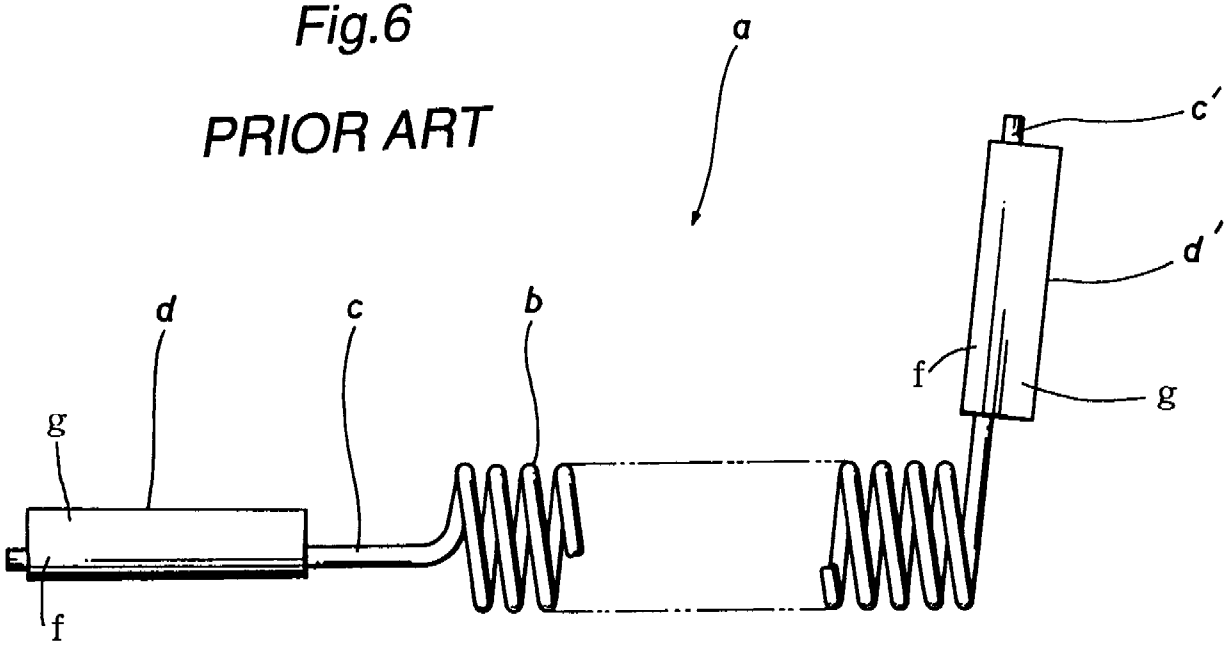
Fig.6 PRIOR ART

The cylindrical portion 18*a* of the foil body 18 is adapted to be welded to the support wire at a part adjacent to the root of the fin-like portion 18*b* in the above embodiment. However, in the case where the spot electrode h is abutted against the cylindrical portion 18 of the foil 18 in the state where the fin-like portion 18*b* of the foil body 18 being situated to be spaced away from the support wire 7 (8,9) as shown in FIG. 5, the end of the fin-like portion 18*b* should be of course included within the distance corresponding to the outer diameter of the cylindrical portion D.

Incandescent lamps to which the present invention can be applied are not limited to tungsten halogen lamps, but the present invention can be applied widely to light sources employing filaments.

As apparent from the above description, according to the present invention, the portion of the foil body other than the cylindrical portion is situated within the range corresponding to the diameter of the cylindrical portion as measured from the surface of the support, so that the end face of the welding machine is prevented from being in contact with the portion of the foil other than the cylindrical portion when the filament is to be welded onto the support.

Accordingly, the foil is prevented from being pressed at the portion other than the cylindrical portion by the end face of the welding machine to be turned and to cause deformation of the filament.

Although only one embodiment of the present invention has been described herein, it should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed is:

1. A filament structure for an incandescent lamp, comprising:

a filament having a coiled portion and a supporting end portion extended from each tail end of said coiled portion;

a foil body wrapped around each supporting end portion of said filament to form a cylindrical portion and an other portion protruding from said cylindrical portion; and a support with a mounting surface on which said cylindrical portion of said foil body is welded such that the other portion of said foil body is situated within a distance from a plane containing said mounting surface, said distance being less than a diameter of said cylindrical portion.

2. The filament structure for an incandescent lamp according to claim 1, wherein an angle formed between said other portion of said foil body and said support is within the range of about 9° to about 14.5°, said cylindrical portion has a diameter of about 0.3 mm, and said other portion has a length of about 1.2 mm.

3. The filament structure for an incandescent lamp according to claim 2, wherein said angle formed between said other portion of said foil body and said support is about 12°.

4. The filament structure for an incandescent lamp according to claim 1, wherein said cylindrical portion of said foil body is adapted to be welded to said support at a part adjacent to a root of said other portion.

5. The filament structure for an incandescent lamp according to claim 1, wherein said cylindrical portion of said foil body is adapted to be welded to said support at a position spaced away from a root of said other portion.

6. The filament structure for an incandescent lamp according to claim 1, wherein said incandescent lamp is a tungsten halogen lamp.

* * * * *